US008086163B2

(12) United States Patent
Miyoshi

(10) Patent No.: US 8,086,163 B2
(45) Date of Patent: Dec. 27, 2011

(54) SHEET TRANSPORT APPARATUS, DOCUMENT READING APPARATUS, AND IMAGE FORMING APPARATUS

(75) Inventor: Fuminori Miyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 678 days.

(21) Appl. No.: 12/204,876

(22) Filed: Sep. 5, 2008

(65) Prior Publication Data

US 2009/0067861 A1 Mar. 12, 2009

(30) Foreign Application Priority Data

Sep. 11, 2007 (JP) ..... 2007-235646

(51) Int. Cl.
*G03G 15/00* (2006.01)

(52) U.S. Cl. ..... 399/367; 399/51

(58) Field of Classification Search ..... 399/16, 399/23, 51, 395

See application file for complete search history.

(56) References Cited

U.S. PATENT DOCUMENTS

| | | | | |
|---|---|---|---|---|
| 5,677,776 | A * | 10/1997 | Matsuda et al. | 358/475 |
| 5,808,756 | A * | 9/1998 | Matsuda | 358/474 |
| 6,804,474 | B2 | 10/2004 | Morita et al. | |
| 7,003,258 | B2 | 2/2006 | Adachi et al. | |
| 7,551,274 | B1 * | 6/2009 | Wornson et al. | 356/239.1 |
| 7,866,903 | B2 * | 1/2011 | Hatada et al. | 400/76 |
| 2005/0019075 | A1 | 1/2005 | Adachi et al. | |
| 2005/0163519 | A1 * | 7/2005 | Takahashi | 399/49 |
| 2005/0206928 | A1 * | 9/2005 | Itagaki | 358/1.9 |
| 2006/0177246 | A1 * | 8/2006 | Kawada et al. | 399/301 |
| 2010/0075250 | A1 * | 3/2010 | Iihara et al. | 430/270.1 |

FOREIGN PATENT DOCUMENTS

| | | |
|---|---|---|
| CN | 1326760 | 7/2007 |
| JP | 09-186817 | 7/1997 |
| JP | 2003-040490 | 2/2003 |
| JP | 2003-267589 | 9/2003 |
| JP | 2005-212935 | 8/2005 |
| JP | 2005-313497 | 11/2005 |

* cited by examiner

*Primary Examiner* — Daniel J Colilla
*Assistant Examiner* — Allister Primo
(74) *Attorney, Agent, or Firm* — Renner, Otto, Boisselle & Sklar, LLP

(57) ABSTRACT

One embodiment of a sheet transport apparatus is provided with a sheet transport path for transporting a sheet in a predetermined transport direction, a reflective type optical sensor in which light irradiated from a light-emitting portion to a transported sheet is reflected and reflected light from the sheet is received by a light-receiving portion to detect a presence/absence of the sheet, an irradiated light adjustment portion that adjusts a light amount of the light-emitting portion, a non-image region locating portion that detects an image state on a sheet to locate a non-image region of the sheet, and a control portion that adjusts the light amount of the light-emitting portion by controlling the irradiated light adjustment portion based on a measured value on the non-image region located by the non-image region locating portion.

8 Claims, 11 Drawing Sheets

SHEET TRANSPORT APPARATUS, DOCUMENT READING APPARATUS, AND IMAGE FORMING APPARATUS

CROSS-REFERENCE TO RELATED APPLICATIONS

This application claims priority under 35 U.S.C. §119(a) on Patent Application No. 2007-235646 filed in Japan on Sep. 11, 2007, the entire contents of which are hereby incorporated by reference.

BACKGROUND OF THE INVENTION

1. Field of the Invention

The present invention relates to sheet transport apparatuses, and to document reading apparatuses and image forming apparatuses in which these are provided.

2. Description of the Related Art

It is known that conventional sheet transport apparatuses provided in image forming apparatuses and document reading apparatuses use, as a detection means that detects a presence/absence of a sheet such as a recording paper or a document or the like transported on a sheet transport path, an optical sensor that has a light-emitting portion and a light-receiving portion and detects the presence/absence of the transported sheet according to a magnitude of a light amount at the light-receiving portion received as light from the light-emitting portion.

With these optical sensors, the amount of light emitted from the light-emitting portion (for example, a light-emitting diode (infrared LED) that emits infrared beams) sometimes drops due to change over time. When this happens, even if a sheet is being transported (there is a sheet), a detection error may occur that a sheet is not being transported (there is no sheet).

In consideration of the drop in amount of emitted light due to change over time, it is conceivable to raise the light amount of the light-emitting portion from the beginning, but in this case the drive current to the light-emitting portion increases, thereby incurring a reduction in the life of the light-emitting portion.

In contrast to this, JP 2003-267589A discloses an image forming apparatus in which a determination is performed as to whether or not a transport count number of sheets has reached a predetermined value so as to adjust the light amount of the light-emitting portion.

However, in this image forming apparatus, the light amount of the light-emitting portion is adjusted when the transport count number of sheets has reached the predetermined value, and therefore in a case where the light amount of the light-emitting portion has dropped before the transport count number of sheets has reached the predetermined value, a sensor detection error occurs undesirably.

SUMMARY OF THE INVENTION

It is an object of the present invention to provide a sheet transport apparatus, and a document reading apparatus and an image forming apparatus provided with this, that is capable of adjusting the light amount of the light-emitting portion regardless of the transport count number of sheets, thereby enabling reliable prevention of detection errors in sensors, which occur with change over time.

The present invention provides a following sheet transport apparatus, and a document reading apparatus and image forming apparatus.

(1) Sheet Transport Apparatus

A sheet transport apparatus is provided with a sheet transport path for transporting a sheet in a predetermined transport direction, a reflective type optical sensor, which has a light-emitting portion and a light-receiving portion, and in which light irradiated from the light-emitting portion to a sheet transported on the sheet transport path is reflected and reflected light from the sheet is received by the light-receiving portion to detect a presence/absence of the sheet, an irradiated light adjustment portion that adjusts a light amount of the light-emitting portion, a non-image region locating portion that detects an image state on a sheet to locate a non-image region of the sheet, and a control portion that adjusts the light amount of the light-emitting portion by controlling the irradiated light adjustment portion based on a measured value on the non-image region located by the non-image region locating portion.

(2) Document Reading Apparatus

A document reading apparatus is provided with the sheet transport apparatus according to the present invention and a document reading portion that reads a document and outputs image data, wherein the sheet is a document, and the non-image region locating portion detects an image state of the document based on image data from the document reading portion to locate a non-image region.

(3) Image Forming Apparatus

An image forming apparatus is provided with the sheet transport apparatus according to the present invention, and an input portion into which image data corresponding to an image to be formed on a recording paper is inputted, wherein the sheet is a recording paper, and the non-image region locating portion detects an image state of the recording paper based on image data from the input portion to locate a non-image region.

Here, the non-image region refers to a region on the sheet in which an image is not formed, for example, in a case where the background color of the sheet is white, the non-image region is a white region.

With the sheet transport apparatus, the document reading apparatus, and the image forming apparatus according to the present invention, the control portion adjusts the light amount of the light-emitting portion by controlling the irradiated light adjustment portion based on a measured value on the non-image region located by the non-image region locating portion, and therefore the light amount of the light-emitting portion can be adjusted regardless of a transport count number of the sheets and it becomes possible to reliably prevent detection errors of the sensor that occur with change over time.

Moreover, the non-image region locating portion detects an image state of the sheet to locate a non-image region of the sheet, and the control portion controls the irradiated light adjustment portion based on a measured value on the non-image region located by the non-image region locating portion, and therefore the light amount of the light-emitting portion can be adjusted appropriately regardless of the image state on the sheet.

In the sheet transport apparatus according to the present invention, it is preferable that a guiding member is further provided, which is provided in the sheet transport path and guides a sheet transported toward the reflective type optical sensor such that the sheet is flat.

An embodiment of the sheet transport apparatus according to the present invention can be exemplified by further providing an image memory that stores image data corresponding to an image on a sheet for each page of the sheet, wherein the non-image region locating portion detects an image state of the sheet based on image data stored in the image memory to locate a non-image region, and the control portion irradiates light from the light-emitting portion to the transported sheet and measures reflected light received by the light-receiving portion from a plurality of measurement positions set in advance on the sheet, stores the measurement positions and the measured values, determines, among image positions corresponding to the plurality of stored measurement positions, which image position is within the non-image region located by the non-image region locating portion, and adjusts a light amount of the light-emitting portion by controlling the irradiated light adjustment portion based on the measured value on the measurement position corresponding to the image position located within the non-image region.

An embodiment of the document reading apparatus according to the present invention can be exemplified in that the control portion irradiates light from the light-emitting portion to a transported document and measures reflected light received by the light-receiving portion from a plurality of measurement positions on the document, and after these measurements, determines whether or not the plurality of measurement positions are respectively in a non-image region located by the non-image region locating portion, and adjusts a light amount of the light-emitting portion by controlling the irradiated light adjustment portion based on the measured value on the measurement position corresponding to the image position located within the non-image region which image position are determined among the plurality of measurement positions.

Furthermore, an embodiment of the image forming apparatus according to the present invention can be exemplified in that the control portion irradiates light from the light-emitting portion to a transported recording paper and measures reflected light received by the light-receiving portion from a plurality of measurement positions on the recording paper, and after these measurements, determines whether or not the plurality of measurement positions are respectively in a non-image region located by the non-image region locating portion, and adjusts a light amount of the light-emitting portion by controlling the irradiated light adjustment portion based on the measured value on the measurement position corresponding to the image position located within the non-image region which image position are determined among the plurality of measurement positions.

In the sheet transport apparatus, the document reading apparatus, and the image forming apparatus provided with this configuration, measurements at the plurality of measurement positions can be carried out prior to locating the non-image region. In this way, the light amount of the light-emitting portion can be adjusted efficiently.

Furthermore, in the image forming apparatus according to the present invention, the input portion can be connected to an external device such as a computer that outputs print data or a document reading apparatus having a document reading portion that reads a document and outputs document image data.

An embodiment of the image forming apparatus according to the present invention can be exemplified in that, in a case where it is connected to the external device, a raster processing portion is provided that performs raster processing on the print data inputted from the external device as image data to generate raster image data, and the non-image region locating portion detects a state of an image to be formed on the recording paper based on raster image data generated by the raster processing portion to locate a non-image region. Here, the raster image data is image data expressed as an arrangement of dots (bitmap) for forming an image. Furthermore, an embodiment of the image forming apparatus according to the present invention can be exemplified in that, in a case where it is connected to the document reading apparatus, the non-image region locating portion detects an image state on the document based on document image data outputted from the document reading apparatus to locate a non-image region.

As described above, with the present invention, it is possible to provide a sheet transport apparatus, and a document reading apparatus and an image forming apparatus provided with this, that is capable of adjusting the light amount of the light-emitting portion regardless of the transport count number of sheets, thereby enabling reliable prevention of detection errors in sensors, which occur with change over time.

DESCRIPTION OF THE PREFERRED EMBODIMENTS

Hereinafter, embodiments of the present invention are described with reference to the accompanying drawings. It should be noted that the following embodiment is a single specific example of the present invention and is not of a nature that limits the scope of the present invention.

Figure 1:
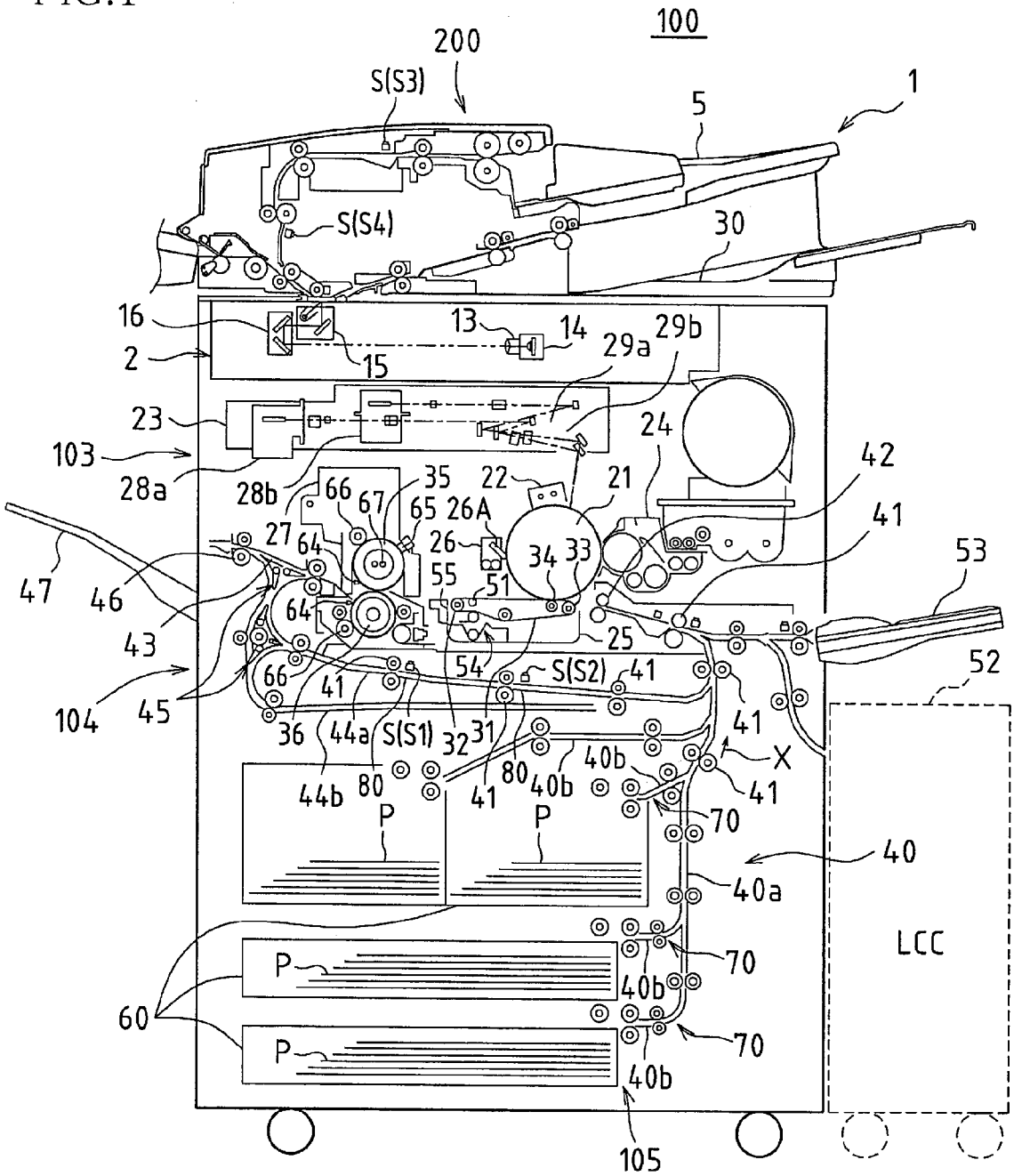
FIG. 1 is an outline configuration drawing of an image forming apparatus provided with a sheet transport apparatus according to an embodiment of the present invention.

FIG. 1 is an outline configuration drawing of an image forming apparatus 100 provided with a sheet transport apparatus according to an embodiment of the present invention.

First, description is given regarding an overall structure of the image forming apparatus 100 shown in FIG. 1. In the present embodiment, the image forming apparatus 100 shown in FIG. 1 forms images using an electrophotographic image forming process. The image forming apparatus 100 is provided with an image bearing member (here, a photosensitive drum) 21, a charging device (here, a charging unit) 22 for charging a surface of the photosensitive drum 21, an exposing device (here, an exposing unit) 23 for forming an electrostatic latent image on the photosensitive drum 21, a development device (here, a development unit) 24 for forming a toner image on the photosensitive drum 21 by developing the electrostatic latent image using a developer, a transfer device (here, a transfer unit) 25 for transferring the toner image on the photosensitive drum 21 to a recording paper P (one example of a sheet), a fixing device (here, a fixing unit) 27 for fixing the transferred image on the recording paper P to the recording paper P, a cleaning device (here, a cleaning unit) 26 for removing residual toner that has not been transferred by the transfer unit 25 and remains on the surface of the photosensitive drum 21, and a control portion 50 (not shown in FIG. 1, see FIG. 4, which is described later).

Specifically, the image forming apparatus 100 forms a monochrome image on the recording paper P in accordance with image data read from a document or image data received from an external device not shown in the diagram. Broadly classified, the structure of the image forming apparatus 100 is constituted by a document reading apparatus 200, an image forming portion 103, a recording paper transport path 40, a recording paper reverse discharge path 104, and a paper feed portion 105. It should be noted that the recording paper reverse discharge path 104 constitutes a sheet transport path.

Figure 2:
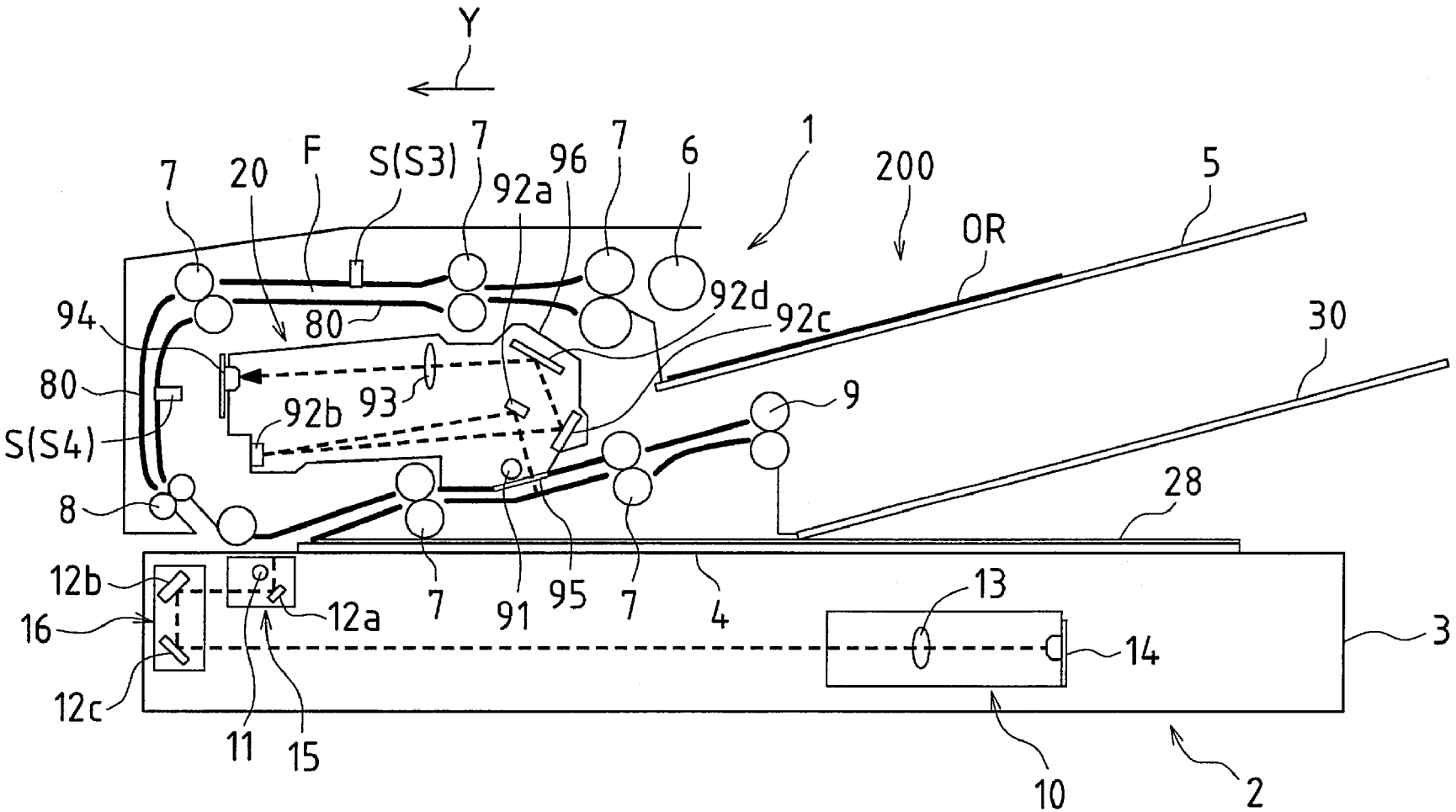
FIG. 2 is a cross-sectional view showing an outline configuration of a document reading apparatus of the image forming apparatus shown in FIG. 1.

FIG. 2 is a cross-sectional view showing an outline configuration of the document reading apparatus 200 of the image forming apparatus 100 shown in FIG. 1.

The document reading apparatus 200 is provided with an automatic document feeding device (hereinafter, "ADF") 1 that transports a document OR (one example of a sheet) in a predetermined document transport direction (Y direction in FIG. 2) along a document transport path F, a first image reading portion 10 that reads an image of a front surface (first surface) side of the document OR that has been transported in or a document that has been positioned, and a second image reading portion 20 that reads an image of a back surface (second surface) side of the document OR that has been transported in. It should be noted that the document transport path F constitutes a sheet transport path.

The first image reading portion 10 is configured so as to read the document OR that has been transported in by the ADF 1. Specifically, the first image reading portion 10 is a reducing optical system reading means that is constituted by a light source 11, a mirror group (here, first to third mirrors 12*a*, 12*b*, and 12*c*), a lens 13 and an imaging device 14 such as a CCD (image sensor). The second image reading portion 20 is a reducing optical system reading means that is constituted by a light source 91, a mirror group (here, first to fourth mirrors 92*a*, 92*b*, 92*c*, and 92*d*), a lens 93 and an imaging device 94 such as a CCD (image sensor). It should be noted that the second image reading portion 20 is implemented as a unit such that the light source 91, the first to fourth mirrors 92*a*, 92*b*, 92*c*, and 92*d*, the lens 93 and the imaging device 94 constitute a single integrated structure.

The document reading apparatus 200 is mainly constituted by the ADF 1, which accommodates the second image reading portion 20, and a document scanning portion 2, which houses the first image reading portion 10.

The ADF 1 and the document scanning portion 2 are coupled by a hinge (not shown in drawings), and the ADF 1 is openable/closable with respect to the document scanning portion 2 by way of rotation of the hinge. And a lower surface of the ADF 1 is configured as a pressing plate 28 that presses from above onto a document to be read that is placed on a platen 4 of the document scanning portion 2.

The document scanning portion 2 is mainly constituted by a casing 3, the platen 4, which is constituted by a transparent glass panel, and the first image reading portion 10, which is housed inside the casing 3.

The first image reading portion 10 is mainly constituted by a light source unit 15, which holds the light source 11 and the first mirror 12*a*, a mirror unit 16, which holds the second mirror 12*b* and the third mirror 12*c*, the lens 13, and the imaging device 14.

The document scanning portion 2 supports both image reading based on a secured document method in which reading is carried out of an image of a document whereby the document has been placed onto the platen 4 by a user, and a moving document method in which an image of a document is read while the document OR is automatically transported by the ADF 1.

When reading a document image using the secured document method, the light source unit 15 and the mirror unit 16 move respectively to home positions corresponding to the secured document method. After this, the light source unit 15 moves in a sub-scanning direction at a constant velocity while irradiating light onto the document to scan an image of the document, and at the same time as this, the mirror unit 16 moves similarly in the sub-scanning direction with a movement velocity that is ½ the movement velocity of the light source unit 15.

After the reflected light from the document irradiated by the light source 11 of the light source unit 15 is reflected by the first mirror 12*a* arranged in the light source unit 15, its optical path is converted by 180° by the second mirror 12*b* and the third mirror 12*c* of the mirror unit 16, and the light that is reflected from the third mirror 12*c* forms an image on the imaging device 14 via the lens 13, and thereby here an image of the document is read and converted to electrical signals.

On the other hand, when reading a document image using the moving document method, the light source unit 15 and the mirror unit 16 remain stationary at the home position shown in FIG. 2 and light is irradiated from the light source 11 onto the document OR, which is transported by the ADF 1 so as to pass over the home position, thereby scanning a document image, and after light reflected from the front surface side of the document OR is reflected by the first mirror 12*a* in a same manner as in the above-described secured document method, its optical path is converted by 180° by the second mirror 12*b* and the third mirror 12*c* of the mirror unit 16 and forms an image on the imaging device 14 via the lens 13, and thereby here an image of the document is read and converted to electrical signals. It should be noted that sensors (for example, reflective type optical sensors S (S3 and S4) to be described later) that detect a position or the like of the document OR are arranged at various locations on a document transport path F. In this way, document transport rollers 7 and registration rollers 8 are rotationally driven in accordance with positions of the document OR detected by the various sensors and the document OR undergoes transport and positioning control.

The ADF 1 is mainly constituted by a draw-in roller 6 that draws in sheet by sheet documents OR that have been loaded on a document stage 5, a plurality of pairs of the document transport rollers 7 that transport drawn-in documents OR along the document transport path F, registration rollers 8 that regulate a paper-feed timing, and discharge rollers 9 that discharge the documents OR for which image reading has been completed to a discharge tray 30, and is arranged such that the second image reading portion 20, which has been implemented as a unit, is accommodated within the document transport path F, which delineates a substantially U-shaped arc.

The second image reading portion 20 is mainly constituted by the light source 91, the first mirror 92*a*, the second mirror 92*b*, the third mirror 92*c*, the fourth mirror 92*d*, the lens 93, and the imaging device 94, and these various members are implemented as a unit by being housed within a unit casing 96 so as to constitute a single integrated structure. It should be noted that in the second image reading portion 20, the light source 91, the lens 93, and the imaging device 94 are identical to equivalent members that constitute the first image reading portion 10.

As described above, when a request for double-side reading is performed by a user, the second image reading portion 20 reads an image of the back surface side of the document OR that is transported on the document transport path F. Specifically, after an image has been read of the front surface side of the document OR by the first image reading portion 10, the document OR passes below the light source 91 of the second image reading portion 20 while being transported along the document transport path F toward the discharge tray 30. At this time, the light source 91 of the second image reading portion 20 irradiates light onto the back surface side of the document OR, and the light that is reflected from the back surface side of the document OR passes through a reading window 95, which is formed by a transparent member such as a glass, and undergoes successive optical path conversion by the first to fourth mirrors 92*a*, 92*b*, 92*c*, and 92*d*, after which an image is formed on the imaging device 94 via the lens 93, and thereby here an image of the document is read and converted to electrical signals.

After the thus-converted electrical signals are converted to digital signals as image data, various types of image processing are executed under the control of the control portion 50, which includes a microcomputer 56 or the like, then these are outputted to the image forming portion 103.

The image forming portion 103 is for recording an image onto the recording paper P based on the image data, and is provided with the aforementioned photosensitive drum 21, the charging unit 22, the exposing unit 23, the development unit 24, the transfer unit 25, the cleaning unit 26, and the fixing unit 27.

The charging unit 22 is a charging means for uniformly charging the surface of the photosensitive drum 21 to a predetermined electric potential and in the present embodiment, is configured as a charger type device. It should be noted that the charging unit 22 may also be a roller type or brush type unit that makes contact with the photosensitive drum 21.

In the present embodiment, the exposing unit 23 is a laser scanning unit (LSU) provided with two laser irradiation portions 28*a* and 28*b*, and two mirror groups 29*a* and 29*b*. The exposing unit 23 launches laser light corresponding to the inputted image data from the laser irradiation portions 28*a* and 28*b* respectively. Furthermore, the exposing unit 23 irradiates these laser lights onto the photosensitive drum 21 via the mirror groups 29*a* and 29*b* to expose the surface of the photosensitive drum 21, which has been uniformly charged by the charging unit 22. Due to this, an electrostatic latent image can be formed on the surface of the photosensitive drum 21. In the present embodiment, the exposing unit 23 employs a two beam system provided with the two laser irradiation portions 28*a* and 28*b* to support high speed image forming processing, such that the load due to faster irradiation timing can be decreased. It should be noted that instead of the laser scanning unit, an EL writing head or an LED writing head in which light-emitting elements are lined up in an array may be used as the exposing unit 23.

The development unit 24 supplies toner to the surface of the photosensitive drum 21 to develop the electrostatic latent image and form a toner image (also referred to as "visible image") on the surface of the photosensitive drum 21.

In the present embodiment, the transfer unit 25 is provided with a transfer belt 31, a drive roller 32, an idler roller 33, and an elastic conductive roller 34. The surface of the transfer belt 31 spans these rollers 32 to 34 and other rollers in a tensioned state. The transfer belt 31 moves due to rotation of these rollers, thereby transporting the recording paper P that has been placed on the surface thereof. The transfer belt 31 has a predetermined resistance value (for example, $1\times10^{9}$ to $1\times10^{13}$ Ω/cm). The elastic conductive roller 34 presses against the surface of the photosensitive drum 21 through the transfer belt 31. Due to this, the recording paper P on the surface of the transfer belt 31 can be pushed against the surface of the photosensitive drum 21. A transfer electric field having an opposite polarity to the charge of the toner image on the surface of the photosensitive drum 21 is applied to the elastic conductive roller 34. Due to this transfer electric field of an opposite polarity, the toner image on the surface of the photosensitive drum 21 can be transferred to the recording paper P on the transfer belt 31. For example, when the toner image has a charge of a negative (−) polarity, the polarity of the transfer electric field applied to the elastic conductive roller 34 is a positive (+) polarity. Due to the elasticity of the elastic conductive roller 34 in the transfer unit 25, the photosensitive drum 21 and the transfer belt 31 do not make line contact, but rather make surface contact having a predetermined width (referred to as a transfer nip). Due to this, the transfer efficiency onto the transported recording paper P can be improved.

A charge removal roller 51, which is for performing charge removal on the recording paper P that has been charged by a voltage applied when it passes a contact portion with the photosensitive drum 21 so that transport to subsequent processes is carried out smoothly, is arranged on a downstream side of the transfer region in the transport direction of the transfer belt 31. The charge removal roller 51 is arranged in contact with a rear surface of the transfer belt 31 (a surface on an opposite side from the surface where the recording paper P is transported). Furthermore, a belt cleaning unit 54, which removes toner on the transfer belt 31, and a charge removal mechanism 55, which carries out charge removal on the transfer belt 31, are arranged in the transfer unit 25. The charge removal mechanism 55 employs a technique of grounding the transfer belt 31 or employs a technique of actively applying to the transfer belt 31 a polarity opposite to the polarity of the transfer electric field.

The fixing unit 27 applies heat and pressure to the recording paper P to cause the toner image to thermally fix onto the recording paper P. Specifically, the fixing unit 27 is provided with a hot roller 35 and a pressure roller 36. A recording paper separation claw 64, a roller surface temperature detection member (thermistor) 65, and a roller surface cleaning member 66 are arranged on an outer circumferential surface of the hot roller 35. A heat source 67 is provided on an inner side of the hot roller 35 in order to heat the surface of the hot roller 35 to a predetermined temperature (fixing temperature: approximately 160° C. to 200° C.). Furthermore, a pressure-applying member not shown in the drawings is arranged at both ends of the pressure roller 36 so that the pressure roller 36 is pressed into contact with the hot roller 35 with a predetermined pressure. A recording paper separation claw 64 and a roller surface cleaning member 66 are arranged on an outer circumferential surface of the pressure roller 36 in a same manner as at the outer circumferential surface of the hot roller 35.

When the recording paper P is transported to a pressing portion (referred to as a fixing nip portion) between the hot roller 35 and the pressure roller 36, the fixing unit 27 subjects the unfixed toner image on the recording paper P to thermal melting and pressure while the recording paper P is being transported by the rollers 35 and 36. Due to this, the toner image can be fixed onto the recording paper P.

The cleaner unit 26 has a cleaning blade 26A that removes and collects toner that is residual on the surface of the photosensitive drum 21 after development and transfer.

In the present embodiment, the recording paper transport path 40 guides the recording paper P from a plurality of paper feed trays 60 in the paper feed portion 105 to the image forming portion 103. Specifically, a plurality of pairs of transport rollers 41 for transporting the recording paper P and a pair of registration rollers 42 are provided on the recording paper transport path 40. The pair of registration rollers 42 transports the recording paper P from the plurality of pairs of transport rollers 41 synchronized with the electrostatic latent image on the photosensitive drum 21. The pair of registration rollers 42 is arranged on an upstream side from the photosensitive drum 21 in the recording paper transport direction (X direction in the diagram) and on a downstream side from the plurality of pairs of transport rollers 41. Specifically, the pair of registration rollers 42 is arranged near the upstream side in the recording paper transport direction X of the photosensitive drum 21.

In the recording paper transport path 40, the plurality of pairs of transport rollers 41 are configured to take in the recording paper P from the paper feed trays 60 via a paper feed mechanism 70, and transport the recording paper P until a leading edge of the recording paper P reaches the registration rollers 42. That is, the plurality of pairs of transport rollers 41 are configured to transport the recording paper P such that the leading edge of the recording paper P reaches and contacts the registration rollers 42, which are temporarily stopped, until the recording paper P bends there. Due to an elastic force of the bent recording paper P, the leading edge portion of the recording paper P can be aligned parallel to the registration rollers 42. After this, due to the registration rollers 42 being rotationally driven, the recording paper P is transported to the transfer unit 25 of the image forming portion 103.

In the present embodiment, the recording paper reverse discharge path 104 that constitutes the sheet transport path is provided with a transport path 43 and the reverse transport paths 44*a* and 44*b*. A plurality of branching claws 45 and a pair of discharge rollers 46 are provided in the recording paper reverse discharge path 104.

The recording paper reverse discharge path 104 is configured such that the recording paper P, which has undergone image forming by the image forming portion 103, is transported by the discharge rollers 46 to the discharge tray 47 via the transport path 43. And in a case where image forming is to be performed also on the back surface of the recording paper P, the recording paper reverse discharge path 104 is configured such that by selectively switching the plurality of pairs branching claws 45 respectively, the recording paper P is guided from the transport path 43 to the reverse transport path 44*b*, where transport of the recording paper P is temporarily stopped. Further still, the recording paper reverse discharge path 104 is configured such that by again selectively switching the branching claws 45, the recording paper P is guided from the reverse transport path 44*b* into the reverse transport path 44*a*. In this way, the recording paper P is reversed front to back and returned to the registration rollers 42 via the reverse transport path 44*a* and the recording paper transport path 40 such that an image is formed also on the back surface.

It should be noted that sensors (for example, reflective type optical sensors S (S1 and S2) to be described later) that detect a position or the like of the recording paper P are arranged at various locations on the recording paper transport path 40 and the recording paper reverse discharge path 104. In this way, the transport rollers 41 and the registration rollers 42 are rotationally driven in accordance with positions of the recording paper P detected by the various sensors and the recording paper P undergoes transport and positioning control.

The paper feed portion 105 is provided with the plurality of paper feed trays 60 and a plurality of paper feed mechanisms 70 arranged corresponding to these. Each of the paper feed trays 60 is a tray for storing a plurality of sheets of the recording paper P and in the present embodiment are provided in a lower portion of the image forming apparatus 100.

Since an object of the image forming apparatus 100 in the present embodiment is high speed image forming, each of the paper feed trays 60 ensures a capacity capable of storing from 500 to 1,500 sheets of standard size recording papers P such as A4, A3, B4, and the like.

Furthermore, at a lateral surface of the image forming apparatus 100 are provided a large capacity paper feed cassette (LCC) 52, which is capable of storing large volumes of multiple types of the recording paper P, and a manual paper feed tray 53 mainly for supplying recording paper P of non-standard sizes and/or of small amounts.

The discharge tray 47 is arranged at a lateral surface of an opposite side to the manual paper feed tray 53. Instead of the discharge tray 47, the image forming apparatus 100 can be configured such that post processing devices for discharged recording paper (for example, post processing devices for stapling, punching and the like) or a plurality of levels of discharge trays are arranged as options.

It should be noted that since the transport path for transporting the recording paper P from the paper feed trays 60 to the image forming portion 103 is shared, the recording paper transport path 40 has a single main transport path 40*a* and a plurality of sub transport paths 40*b* for transporting the recording papers P from the plurality of paper feed trays 60 respectively to the main transport path 40*a*. That is, the main transport path 40*a* is configured such that the recording papers P from the plurality of paper feed trays 60 are guided via their corresponding sub transport paths 40*b*.

Furthermore, the reflective type optical sensors S are provided on the sheet transport path. The reflective type optical sensors S detect the presence/absence of sheets P and OR transported on the sheet transport path. The reflective type optical sensors S can be arranged at arbitrary locations (for example, on the transport path where the recording paper P is transported after image forming) so as to detect the presence/absence of the recording paper P within the transport path where the recording paper P is transported. Specifically, the reflective type optical sensors S can be arranged (see S1 and S2 in FIG. 1) within the recording paper reverse discharge path 104. Furthermore, the reflective type optical sensors S can be arranged at arbitrary locations so as to detect the presence/absence of the document OR within the transport path where the document OR is transported. Specifically, the reflective type optical sensors S can be arranged (see S3 and S4 in FIG. 2) within the document transport path F in the document reading apparatus 200. The reflective type optical sensors S are described in detail later.

The control portion 50 controls the overall operations of the image forming apparatus 100 including the document reading apparatus 200 and, for example, is provided with a microcomputer 56 and a storage portion 57. The storage portion 57 includes a ROM (read only memory), a RAM (random access memory), and a nonvolatile memory.

The ROM stores control programs, which are procedures for processing to be executed by the microcomputer 56. The RAM provides a work area for operations. The nonvolatile memory backs up and holds data required in control.

It should be noted that the control portion 50 is configured to carry out timing control of members such motors, solenoids, and lamps and the like that are connected to its output system based on input signals from members such as various sensors and switches and the like connected to its input system.

Next, description is given regarding sheet transport operations in the image forming apparatus 100 shown in FIG. 1. Sheet transport operations are performed under the control of the control portion 50.

That is, in the document reading apparatus 200, the document OR that has been placed on the document stage 5 is transported by the document transport rollers 7 in the document transport path F until the registration rollers 8, then reaches the registration rollers 8 and temporarily stops. In the image forming apparatus 100, the registration rollers 8 are caused to rotate together with the document transport rollers 7 under the operational control of the control portion 50, thereby transporting the document OR, which had been temporarily stopped, to the image reading portions 10 and 20. Then, under the operational control of the control portion 50, the image forming apparatus 100 reads an image(s) of the document OR that has been transported to the image reading portions 10 and 20, and discharges it to the discharge tray 30.

On the other hand, in the image forming portion 103, the recording paper P selected from among the plurality of paper feed trays 60 matching the print request is transported by the transport rollers 41 in the recording paper transport path 40 until the registration rollers 42, then reaches the registration rollers 42 and temporarily stops. Under the operational control of the control portion 50, the image forming apparatus 100 causes the registration rollers 42 to rotate together with the transport rollers 41 with a timing by which the toner image formed on the photosensitive drum 21 and the recording paper P are synchronized, thereby transporting the recording paper P to the transfer unit 25. Then, under the operational control of the control portion 50, the image forming apparatus 100 causes the toner image on the photosensitive drum 21 to be transferred to the recording paper P that has been transported to the transfer unit 25, after which the recording paper P is guided to the fixing unit 27 where the transferred toner image is fastened, then further discharged to the discharge tray 47.

Figure 3A:
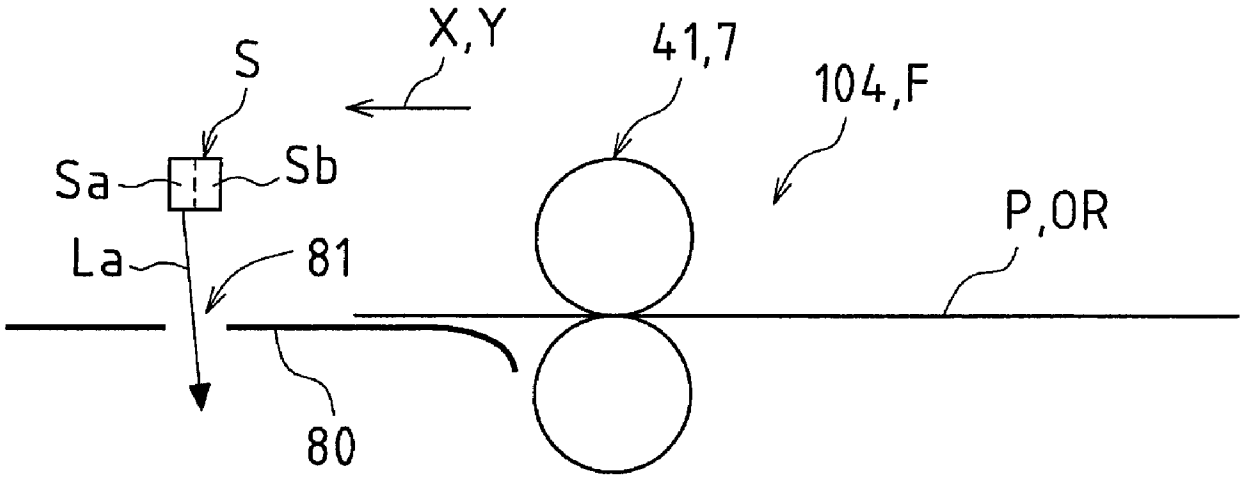
FIG. 3(*a*) and FIG. 3(*b*) are outline side drawings showing states in which a sheet is detected by a reflective type optical sensor in a sheet transport path, with FIG. 3(*a*) showing a state in which the transported sheet is not passing the sensor and FIG. 3(*b*) showing a state in which the transported sheet is passing the sensor.
Figure 3B:
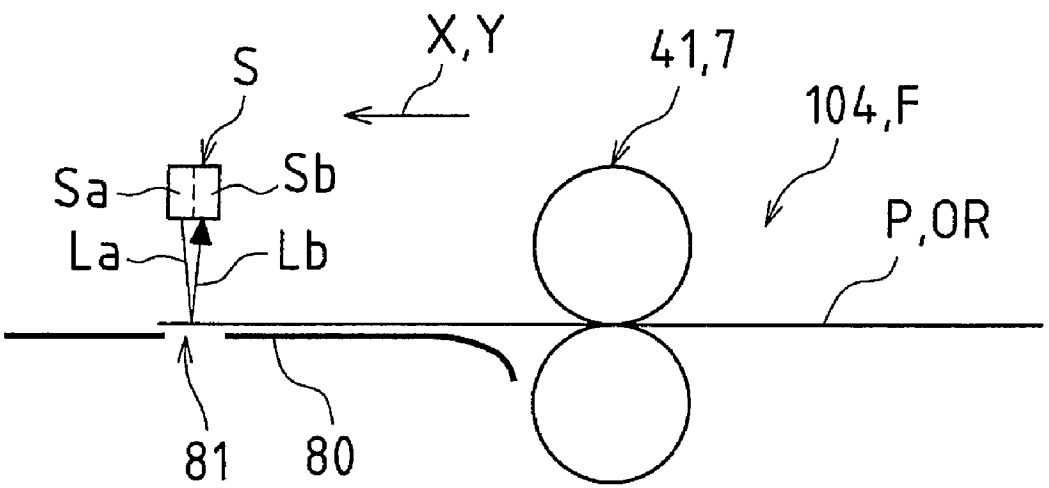

FIG. 3(*a*) and FIG. 3(*b*) are outline side drawings showing states in which a sheet (recording paper P or document OR) is detected by a reflective type optical sensor S in the sheet transport path (for example, the recording paper reverse discharge path 104 and the document transport path F), with FIG. 3(*a*) showing a state in which the transported sheet P or OR is not passing the sensor S (no sheet P or OR), and FIG. 3(*b*) showing a state in which the transported sheet P or OR is passing the sensor S (a sheet P or OR is present). It should be noted that in FIG. 3(*a*) and FIG. 3(*b*), in a case where the reflective type optical sensor S is provided in the recording paper reverse discharge path 104, an example is shown in which it is provided between first transport rollers 41 and second transport rollers 41, which are arranged on a downstream side in the recording paper transport direction X of the first transport rollers 41. And in a case where the reflective type optical sensor S is provided in the document transport path F, an example is shown in which it is provided between first document transport rollers 7 and second document transport rollers 7, which are arranged on a downstream side in the document transport direction Y of the first document transport rollers 7.

The reflective type optical sensor S has a light-emitting portion Sa and a light-receiving portion Sb, and is configured such that an irradiated light La from the light-emitting portion Sa is reflected by the sheet P or OR that is transported, and a reflected light Lb from the sheet P or OR is received by the light-receiving portion Sb so as to detect the presence/absence of the sheet P or OR. In this way, the reflective type optical sensor S can detect the presence/absence of the sheet P or OR according to the magnitude of the light amount at the light-receiving portion Sb received from the reflected light Lb from the sheet P or OR after the light La from the light-emitting portion Sa is irradiated onto the sheet P or OR that is transported.

In the present embodiment, a guiding member 80 is provided in the sheet transport path to guide the sheet P or OR such that the sheet P or OR transported toward the reflective type optical sensor S is flat. That is, the guiding member 80 guides the sheet P or OR so that the sheet P or OR is flat at least at a position facing a detection surface of the reflective type optical sensor S. Here, an opening 81 is provided in the guiding member 80 at a position facing the detection surface of the reflective type optical sensor S (namely, a position facing the light La from the light-emitting portion Sa). The opening 81 fulfills a role of allowing the light La from the light-emitting portion Sa to pass so as to avoid the light La from the light-emitting portion Sa being reflected and not received at the light-receiving portion Sb when there is no sheet P or OR.

Figure 4:
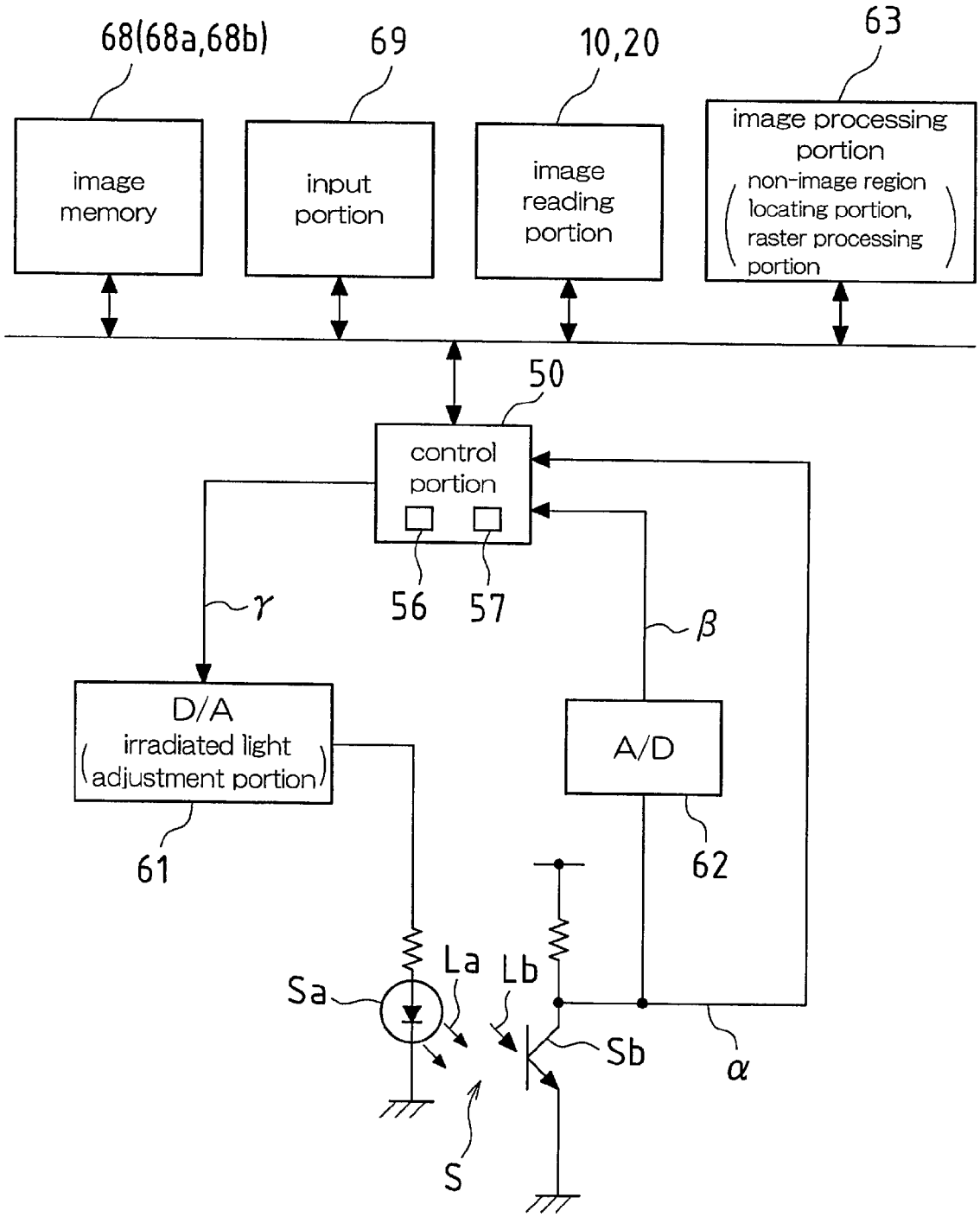
FIG. 4 is an outline block diagram centrally showing a control portion and the reflective type optical sensor in the image forming apparatus shown in FIG. 1.

FIG. 4 is an outline block diagram centrally showing the control portion 50 and the reflective type optical sensor S in the image forming apparatus 100 shown in FIG. 1.

As shown in FIG. 4, the light-emitting portion Sa of the reflective type optical sensor S is connected to the output system of the control portion 50 via a D/A converter 61. The D/A converter 61 serves as an irradiated light adjustment portion, and is configured so as to be capable of adjusting the light amount of the irradiated light La of the light-emitting portion Sa under the direction of the control portion 50. In this way, by driving the light-emitting portion Sa according to the output of the D/A converter 61, the light amount is adjusted. Here, the light-emitting portion Sa is configured as an infrared LED that emits infrared light.

The light-receiving portion Sb is configured so as to output an analog signal (a voltage value shown by $\alpha$ in FIG. 4) of reflected light Lb received from the sheet P or OR as a measured value. The light-receiving portion Sb is connected to the input system of the control portion 50 by two lines. That is, with one line, the light-receiving portion Sb is directly connected to the input system of the control portion 50, and with the other line, it is connected to the input system of the control portion 50 via an A/D converter 62. The A/D converter 62 converts the analog output from the light-receiving portion Sb to a digital value. Here, the light-receiving portion Sb is configured as a phototransistor for infrared light that receives infrared light from the light-emitting portion Sa.

The image forming apparatus 100 is further provided with an image processing portion 63 that processes image data. The image processing portion 63 is connected to the control portion 50. Here, the image processing portion 63 has a function of non-image region locating portion that detects an image state on the sheet P or OR and locates a non-image region (a region in which an image is not formed) of the sheet P or OR.

The sheet transport apparatus according to the present embodiment is constituted by the sheet transport path, the reflective type optical sensor S, an irradiated light adjustment portion 61, a non-image region locating portion 63, and the control portion 50.

And the control portion 50 is configured so as to adjust the light amount of the light-emitting portion Sa by controlling the irradiated light adjustment portion 61 based on a measured value on a non-image region located by the non-image region locating portion 63.

With an image forming apparatus 100 provided with a sheet transport apparatus according to the present embodiment, using the reflective type optical sensor S that detects the presence/absence of the sheet P or OR according to the reflected light Lb from the sheet P or OR, it is possible to adjust the light amount of the light-emitting portion Sa according to the reflected light Lb from the non-image region of the sheet P or OR being transported. In this way, the light amount of the light-emitting portion Sa can be adjusted regardless of a transport count number of the sheets P or OR and it becomes possible to reliably prevent detection errors of the sensor S that occur with change over time.

Furthermore, it is possible to execute light amount adjustments of the light-emitting portion Sa during operation of the apparatus without stopping the apparatus during operation to perform light amount adjustments of the light-emitting portion Sa.

Further still, the non-image region locating portion 63 detects an image state on the sheet P or OR to locate a non-image region of the sheet P or OR, and the control portion 50 controls the irradiated light adjustment portion 61 based on a measured value on the non-image region located by the non-image region locating portion 63, and therefore light amount adjustments of the light-emitting portion Sa can be executed appropriately regardless of what kind of image is formed on the sheet P or OR that is transported.

In this regard, the control portion 50 may be configured such that, after the non-image region has been located in advance by the non-image region locating portion 63, it irradiates light from the light-emitting portion Sa to the located non-image region and measures the reflected light at the light-receiving portion Sb that is reflected from the non-image region, thereby controlling the irradiated light adjustment portion 61 based on the measured value on the non-image region located by the non-image region locating portion 63, but unfortunately in this case, for example, the recording paper P is transported after the non-image region is located, and therefore the commencement of measuring of the reflected light Lb from the recording paper P is delayed by the time required for locating the non-image region.

Accordingly, in the present embodiment, the control portion 50 is configured so as to irradiate light from the light-emitting portion Sa to the sheet P or OR that is transported and measure the reflected light Lb received by the light-receiving portion Sb from a plurality of measurement positions that have been set in advance on the sheet P or OR, and after these measurements, the control portion 50 determines whether or not the plurality of measurement positions are respectively in the non-image region located by the non-image region locating portion 63 and controls the irradiated light adjustment portion 61 based on the measured value on the measurement position within the non-image region among the plurality of measurement positions, thereby adjusting the light amount of the light-emitting portion Sa. By doing this, an effect is achieved of preventing a drop in processing efficiency without delaying the commencement of measuring the reflected light Lb from the sheet P or OR.

That is, using an image memory 68, which is an image memory 68 (68*a*, 68*b*) provided in the image forming apparatus 100 or the document reading apparatus 200 that stores image data corresponding to the image on the sheets P or OR for each page of the sheets P or OR, measurement of the reflected light Lb from the sheet P or OR is carried out first, and the locating of the non-image region is executed by referencing the image data remaining in the image memory 68.

Specifically, the control portion 50 irradiates light from the light-emitting portion Sa to the sheet P or OR that is transported, then measures the reflected light Lb received by the light-receiving portion Sb from the plurality of measurement positions that are set in advance, and stores the measurement positions and the measured values in the storage portion 57. After this, the non-image region locating portion 63 detects an image state of the sheet based on the image data stored in the image memory 68 and locates a non-image region. And the control portion 50 is configured so as to store in the storage portion 57 an image position within the non-image region located by the non-image region locating portion 63 among image positions corresponding to the plurality of measurement positions stored in the storage portion 57, then determine a measurement position that matches an image position within the non-image region stored in the storage portion 57 among the plurality of measurement positions stored in the storage portion 57, and control the irradiated light adjustment portion 61 based on the measured value for the measurement position that has matched the image position within the non-image region stored in the storage portion 57, thereby adjusting the light amount of the light-emitting portion Sa.

It should be noted that the image memory 68*a* provided in the image forming apparatus 100 stores raster image data of print data from an input portion 69 for each page of the recording papers P. Furthermore, the image memory 68*b* provided in the document reading apparatus 200 stores document image data from the image reading portions 10 and 20, which generate document image data by reading document images, for each page of the documents OR. Here, the image forming apparatus 100 is connected to an external device (for example, a personal computer) via a communications means such as a LAN (local area network). Here, the input portion 69 is implemented as a LAN interface. The input portion 69 is configured to receive print data from the external device as image data. Furthermore, the image processing portion 63 has a further function as a raster processing portion that performs raster processing on the print data inputted from the external device to generate raster image data.

And the non-image region locating portion 63 is configured such that when print data has been inputted from the input portion 69, it detects a state of the image to be formed on the recording paper P based on the raster image data generated by the raster processing portion and locates a non-image region. Furthermore, the non-image region locating portion 63 is configured such that when document image data has been inputted from the image reading portions 10 and 20, it detects a state of the image on the document OR based on the document image data from the image reading portions 10 and 20 and locates a non-image region.

Figure 5:
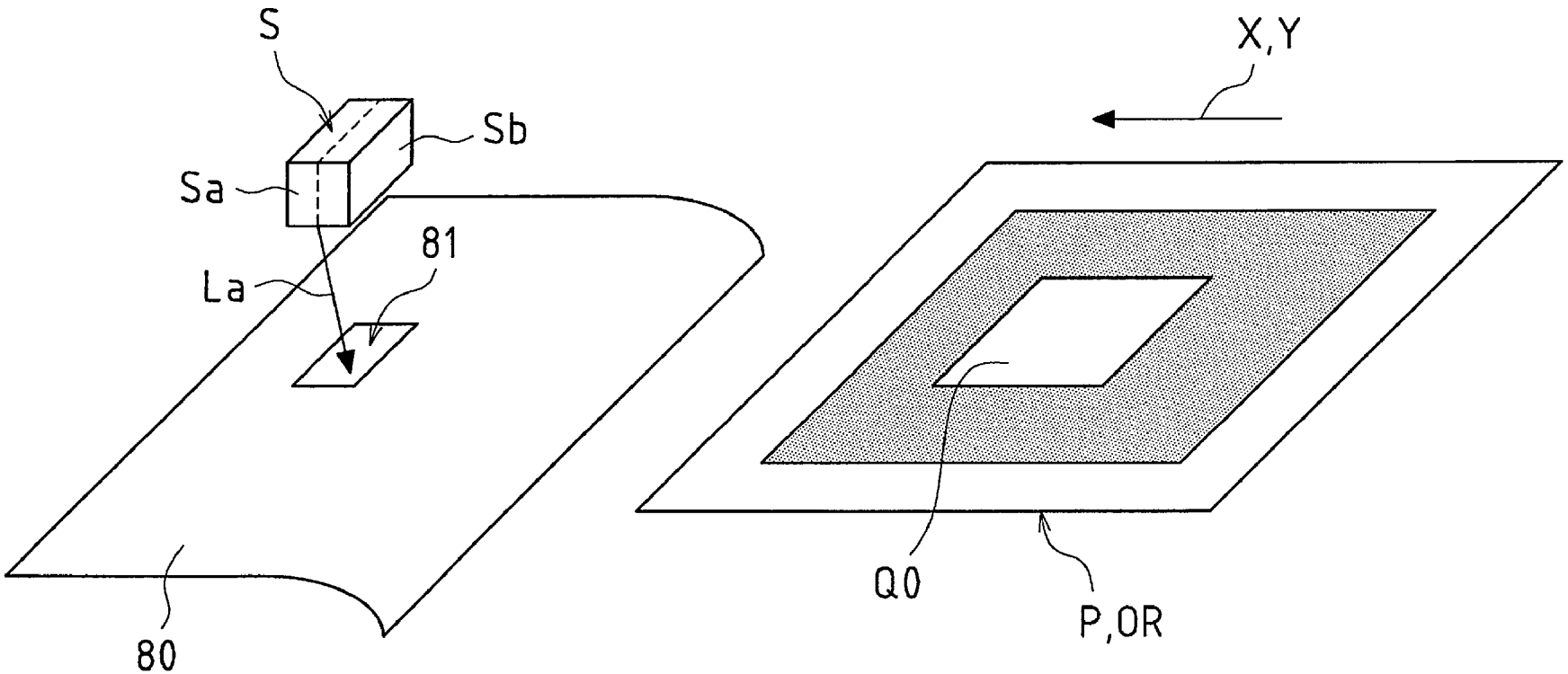
FIG. 5 is a perspective view showing a state immediately before reflected light from a non-image region of the sheet is measured.
Figure 6:
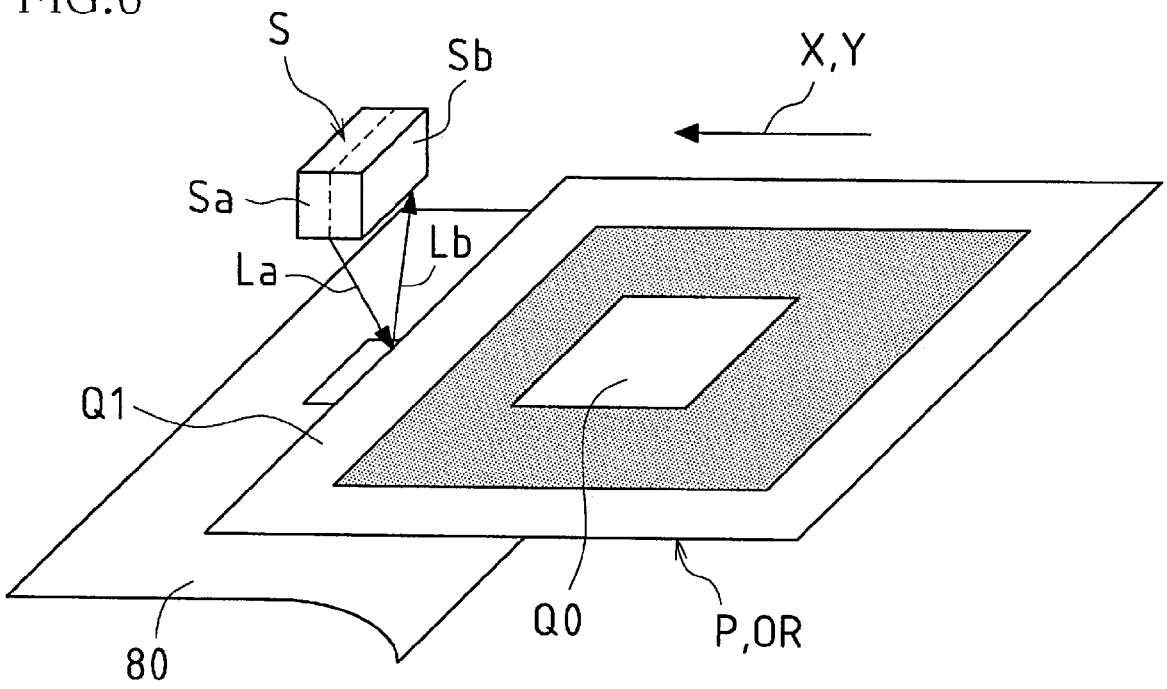
FIG. 6 is a perspective view showing a detection state of the transported sheet at an edge portion on a downstream side in the transport direction.

FIG. 5 is a perspective view showing a state immediately before reflected light from a non-image region Q0 of the sheet P or OR is measured, and FIG. 6 is a perspective view showing a detection state of the transported sheet P or OR at an edge portion Q1 on a downstream side in the transport direction X or Y. It should be noted that in FIG. 5 and FIG. 6, the hatched areas indicate image regions. The same applies for FIG. 7, which is described later. In this example, the non-image region Q0 is present in a central vicinity of the image region.

In the state of the reflective type optical sensor S shown in FIG. 5, the light La from the light-emitting portion Sa passes through the opening 81 of the guiding member 80, and therefore the light La from the light-emitting portion Sa is not received by the light-receiving portion Sb and reflected light Lb is not detected by the light-receiving portion Sb, but in the state shown in FIG. 6, the light La from the light-emitting portion Sa is irradiated on the edge portion Q1 on the downstream side in the transport direction X or Y of the sheet P or OR, and is thereby reflected and detection commences of the reflected light Lb by the light-receiving portion Sb.

Figure 7:
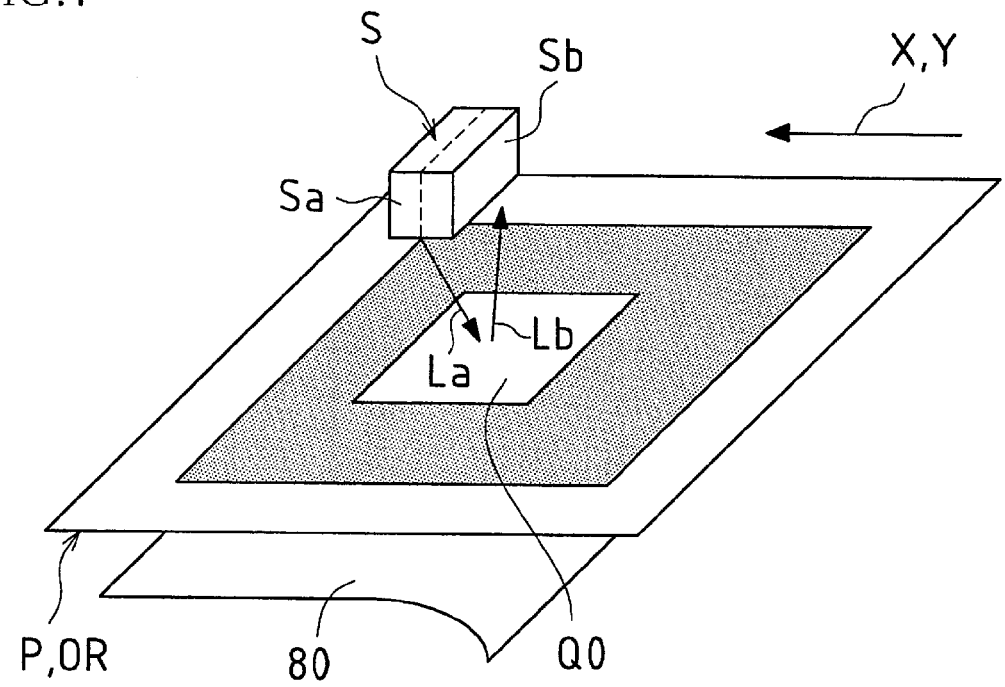
FIG. 7 is a diagram showing a state of measuring a light amount of the reflected light from the non-image region of the sheet.

FIG. 7 is a diagram showing a state of measuring a light amount of the reflected light Lb from the non-image region Q0 of the sheet P or OR.

With the image forming apparatus 100 provided with the sheet transport apparatus according to an embodiment of the present invention, in which position a non-image region (here, a white region) is positioned in the sheet P or OR can be determined according to whether or not raster image data or document image data corresponding to the plurality of measurement positions of the reflective type optical sensor S determined in advance is a background color (here, a white color) by referencing the raster image data, which has been obtained by performing raster processing on the print data, or the document image data from the image reading portions 10 and 20.

Measurements are carried out of the reflected light Lb by the reflective type optical sensor S during transport of the sheet P or OR, and the raster image data or the document image data is stored in the image memory 68 (68*a*, 68*b*) and remains without being cleared after printing, then measured values at measurement positions in the non-image region are used in light amount adjustments of the light-emitting portion Sa as measured values on the non-image region. It should be noted that measured values for regions that are not non-image regions can be deleted without being used.

Next, description is given regarding detection control of the reflective type optical sensor S by the control portion 50. The control portion 50 controls the image memory 68 (68*a*, 68*b*), the input portion 69, the image reading portions 10 and 20, and the image processing portion 63 to execute a document reading operation and an image forming operation.

Figure 8:
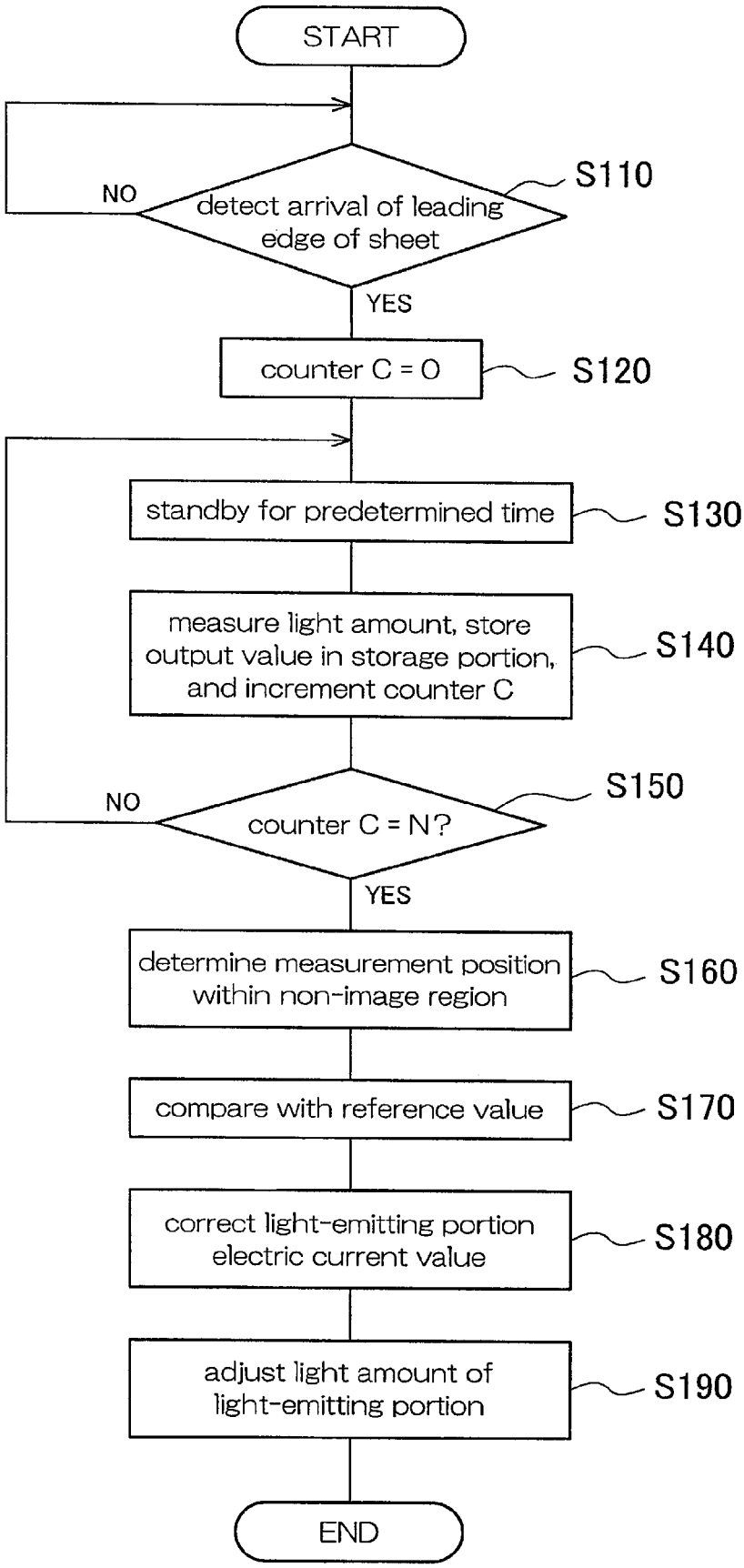
FIG. 8 is a diagram showing one example of a flowchart in which detection control of the reflective type optical sensor is executed by the control portion of the image forming apparatus shown in FIG. 1.

FIG. 8 is a diagram showing one example of a flowchart in which detection control of the reflective type optical sensor S is executed by the control portion 50 of the image forming apparatus 100 shown in FIG. 1.

The flowchart shown in FIG. 8 starts in accordance with an instruction to commence image forming or to commence document reading. First, standby is performed until arrival of an edge in the downstream side in the transport direction X or Y of a first page of the sheet P or OR (leading edge of the sheet P or OR) is detected by the reflective type optical sensor S (step S110: no), then when this is detected (step S110: yes), a counter C is reset (step S120), and after predetermined time of standby is performed (step S130), light is irradiated from the light-emitting portion Sa onto the transported sheet P or OR and the reflected light Lb received from the measurement position of the sheet P or OR at the light-receiving portion Sb is measured, and a measurement position and measured value according to the measurement is stored in the storage portion 57 (for example, the RAM). Specifically, analog output of the phototransistor Sb is converted to a digital output value by the A/D converter 62, and the measurement position and digital output value thereof (a value shown as β in FIG. 4) are stored in the storage portion 57. Then, the counter C is incremented by adding a count of 1 (step S140).

It should be noted that the predetermined time in the aforementioned step S130 is a time from the leading edge of the sheet P or OR until a position set in advance for performing measurement. The measurement position in the sheet transport direction X or Y can be located by this predetermined time and the sheet transport velocity. Furthermore, a measurement position in a direction orthogonal to the sheet transport direction X or Y can be located by a position at which the reflective type optical sensor S is arranged in a direction orthogonal to the sheet transport direction X or Y.

The steps S130 and S140 are repeated until the counter C becomes equal to a predetermined multiple number of times N (here, 10 times) (step S150: no), and when the counter C becomes equal to the predetermined multiple number of times N (step S150: yes), measurements of the multiple number of times N (here, 10 times) are completed.

Next, a position of the non-image region (here, a white region) is located. That is, the document image data or the raster image data after raster processing is stored in the image memory 68 (68*a*, 68*b*). By being sent a command so as to carry out locating of a non-image region, the non-image region locating portion 63 detects an image density (that is, a density of a background color (here, white)) based on the image data that is stored in the image memory 68 (68*a*, 68*b*), thereby locating a non-image region.

Then, image data of the first page in the image memory 68 (68*a*, 68*b*) is referenced, and data of coordinates in the image data corresponding to N measurement positions stored in the storage portion 57 are determined to locate image positions within the non-image region, which is the background color (here, white), and the located image positions are stored in the storage portion 57 (for example, the RAM) (step S160).

It should be noted that in the present embodiment, measurements are carried out at the first page, but the measurements can be executed at an arbitrary page. Furthermore, it is also possible to carry out measurements at all pages from the first page to the final page.

Next, a digital output value (a value shown as β in FIG. 4) of the measured light amount in the non-image region at the image positions stored in the storage portion 57 is compared with a preset reference value (S170), and based on a comparison result thereof, a digital output value (a value shown as γ in FIG. 4) is outputted to the D/A converter 61 so as to correct the electric current value to the light-emitting portion Sa (step S180). Description is given later regarding a correction amount of the electric current value to the light-emitting portion Sa.

Figure 9:
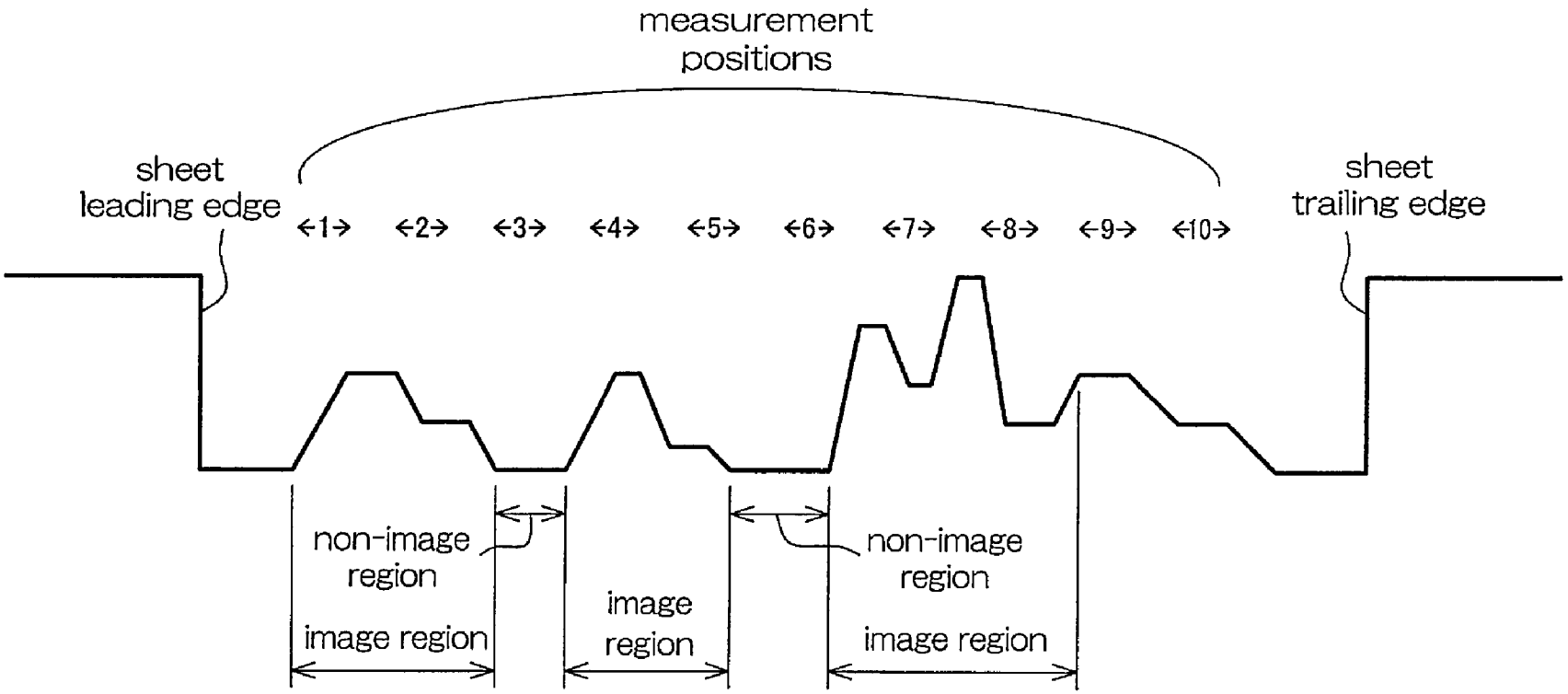
FIG. 9 is a diagram showing change over time in an output voltage of the light-receiving portion in the reflective type optical sensor detected during transport of the sheet.
Figure 10:
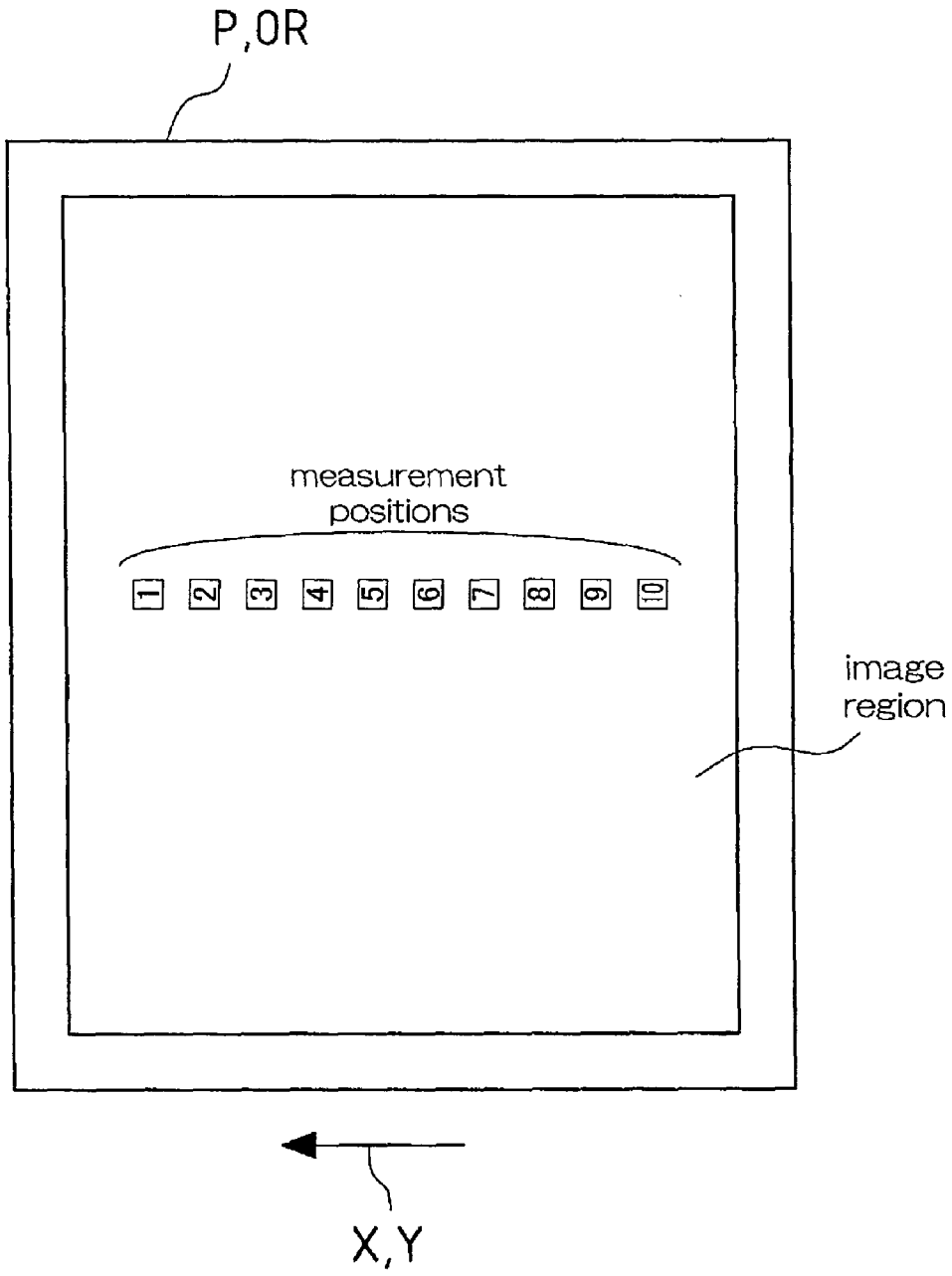
FIG. 10 is a diagram showing one example of measurement positions of the reflective type optical sensor on the sheet.

FIG. 9 is a diagram showing change over time in an output voltage (a voltage value shown as α in FIG. 4) of the light-receiving portion Sb in the reflective type optical sensor S detected during transport of the sheet P or OR, and FIG. 10 is a diagram showing one example of measurement positions of the reflective type optical sensor S on the sheet P or OR. Furthermore, FIG. 11 is a diagram showing one example of a relative positional relationship between measurement positions of the reflective type optical sensor S and image regions (regions indicated by circle-shaped hatching) on the sheet P or OR.

Figure 11:
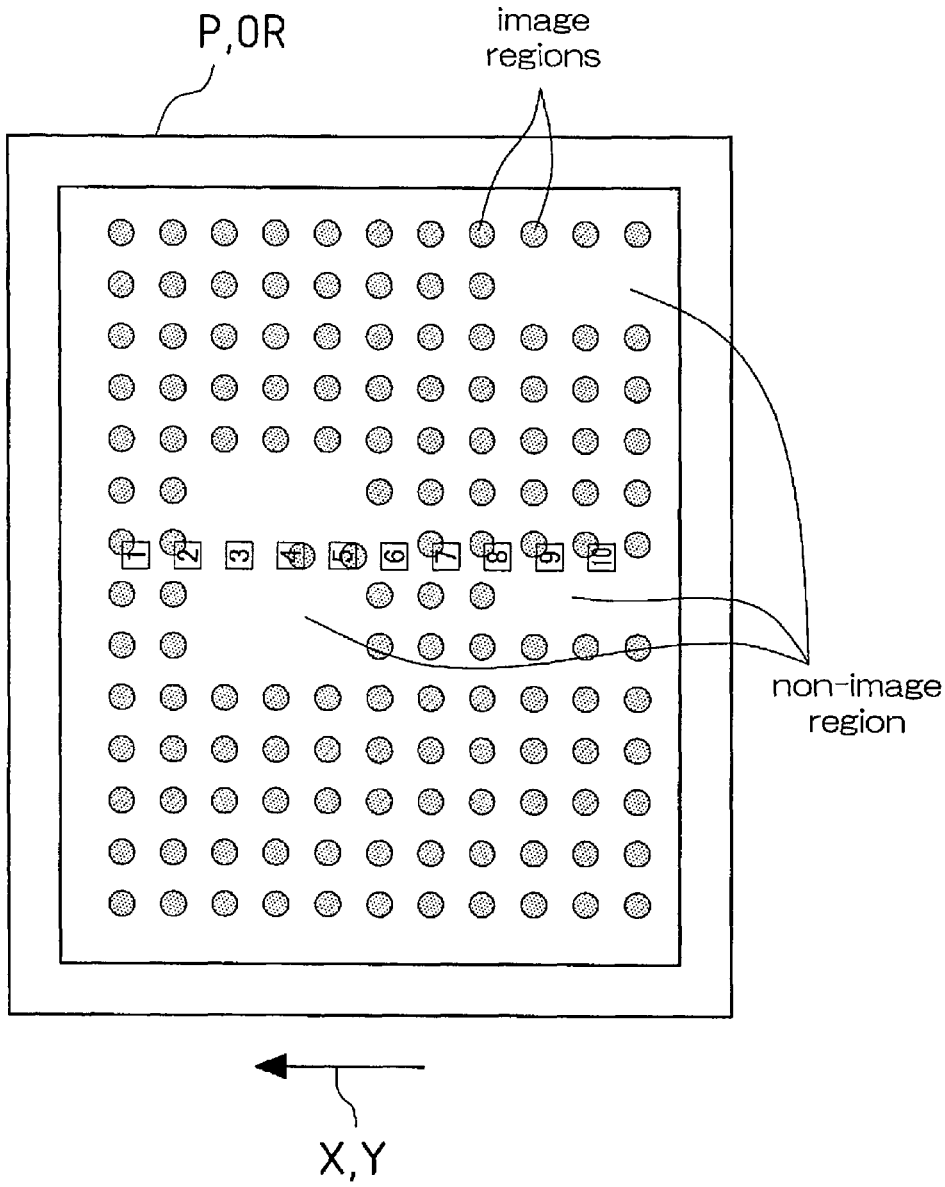
FIG. 11 is a diagram showing one example of a relative positional relationship between measurement positions of the reflective type optical sensor and image regions on the sheet.

As shown in FIGS. 9 to 11, the third and sixth measurement positions of the N number of measurement positions (here, 10) are image positions within the non-image region. Accordingly, the light amount of the light-emitting portion Sa can be corrected based on the measured value at the third or sixth measurement positions.

The D/A converter 61 converts the digital output value (the value shown as γ in FIG. 4) from the control portion 50 to an analog signal (an electric current value to the light-emitting portion Sa), thereby adjusting the light amount of the light-emitting portion Sa (step S190). After the light amount adjustments are all completed, the raster image data or the document image data stored in the image memory 68 (68*a*, 68*b*) is cleared.

Figure 12A:
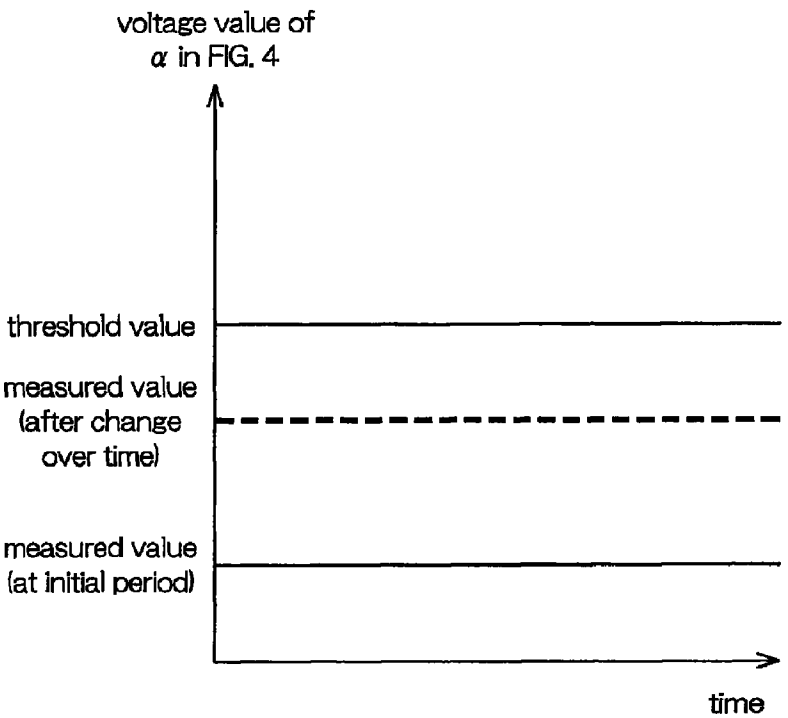
FIG. 12(*a*) and FIG. 12(*b*) are diagrams showing output voltages of the light-receiving portion when the reflected light is received from the non-image region of the sheet, with FIG. 12(*a*) indicating an output voltage before adjustment (see bold dashed line) and FIG. 12(*b*) indicating the output voltage after adjustment (see bold solid line).
Figure 12B:
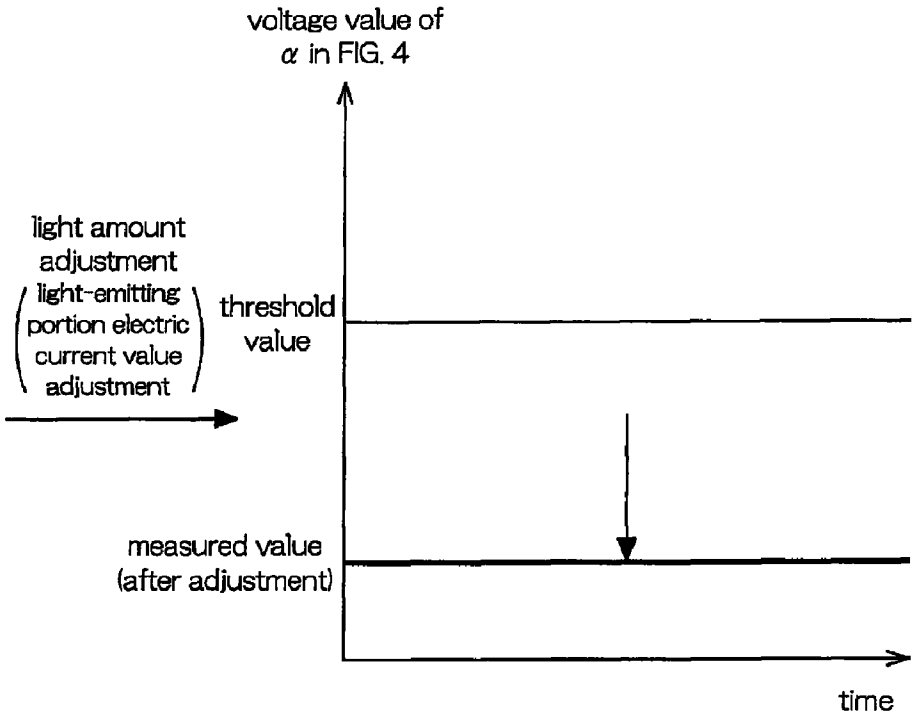

Next, description is given regarding a correction amount of the electric current value to the light-emitting portion Sa. FIG. 12(*a*) and FIG. 12(*b*) are diagrams showing output voltages (voltage value shown as α in FIG. 4) of the light-receiving portion Sb when the reflected light Lb is received from the non-image region Q0 of the sheet P or OR, with the bold dashed line in FIG. 12(*a*) indicating an output voltage before adjustment and a bold solid line in FIG. 12(*b*) indicating the output voltage after adjustment.

It should be noted in regard to a threshold value shown in FIG. 12(*a*) and FIG. 12(*b*) that a voltage not greater than this value is determined as L (low level) when inputted to the control portion 50, and this value indicates a threshold value of the input portion of the control portion 50 for the output voltage of the light-receiving portion Sb to be inputted. In FIG. 12(*a*), the measured value (at an initial period) indicates measured values immediately after use of the reflective type optical sensor S has commenced (at an initial period), and the measured value (after change over time) indicates measured values after long-period use of the reflective type optical sensor S. After change over time in the reflective type optical sensor S, the output value of the light-receiving portion Sb rises due to decreases in the light amount of the light-emitting portion Sa. Furthermore, in FIG. 12(*b*), the measured value (after adjustment) indicates measured values of the light-receiving portion Sb due to light amount adjustments being executed by increasing the electric current supplied to the light-emitting portion Sa. The measured values after adjustment drop until an equivalent extent as the initial period.

When the electric current value of the light-emitting portion Sa at the initial period is set to Io, the measured value of the output voltage (the voltage value shown as α in FIG. 4) of the light-receiving portion Sb at the initial period is set to Ao, and the measured value after change over time is set to A, an electric current value I to the light-emitting portion Sa after correction can be obtained by a following equation (1).

$$I = Io \times A/Ao \qquad \text{Equation (1)}$$

Then the control portion 50 outputs to the D/A converter 61 a voltage value corresponding to the electric current value I of the light-emitting portion Sa after correction with the equation (1).

It should be noted that in the present embodiment, a sheet transport apparatus according to an embodiment of the present invention is provided in the image forming apparatus 100, but by providing a control portion in the document reading apparatus 200, a sheet transport apparatus according to an embodiment of the present invention can be provided in the document reading apparatus 200.

The present invention can be embodied and practiced in other different forms without departing from the gist and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A sheet transport apparatus, comprising:

a sheet transport path for transporting a sheet in a predetermined transport direction, a reflective type optical sensor, which has a light-emitting portion and a light-receiving portion, and in which light irradiated from the light-emitting portion to a sheet transported on the sheet transport path is reflected and reflected light from the sheet is received by the light-receiving portion to detect a presence/absence of the sheet, an irradiated light adjustment portion that adjusts a light amount of the light-emitting portion, an image memory that stores image data corresponding to an image on a sheet for each page of the sheet, a non-image region locating portion that detects an image state on a sheet based on image data stored in the image memory to locate a non-image region of the sheet, and a control portion that adjusts the light amount of the light-emitting portion by controlling the irradiated light adjustment portion based on a measured value on the non-image region located by the non-image region locating portion, wherein the control portion irradiates light from the light-emitting portion to the transported sheet and measures reflected light received by the light-receiving portion from a plurality of measurement positions set in advance on the sheet, stores the measurement positions and the measured values, determines, among image positions corresponding to the plurality of stored measurement positions, which image position is within the non-image region located by the non-image region locating portion, and adjusts a light amount of the light-emitting portion by controlling the irradiated light adjustment portion based on the measured value on the measurement position corresponding to the image position located within the non-image region.

2. The sheet transport apparatus according to claim 1, further comprising a guiding member, which is provided in the sheet transport path and guides a sheet transported toward the reflective type optical sensor such that the sheet is flat.

3. A document reading apparatus comprising:

a sheet transport apparatus that transports a document, and a document reading portion that reads the document and outputs image data, wherein the sheet transport apparatus comprises:

a sheet transport path for transporting the document in a predetermined transport direction, a reflective type optical sensor, which has a light-emitting portion and a light-receiving portion, and in which light irradiated from the light-emitting portion to the document transported on the sheet transport path is reflected and reflected light from the document is received by the light-receiving portion to detect a presence/absence of the document, an irradiated light adjustment portion that adjusts a light amount of the light-emitting portion, a non-image region locating portion that detects an image state on the document based on image data stored in an image memory to locate a non-image region of the document, and a control portion that adjusts the light amount of the light-emitting portion by controlling the irradiated light adjustment portion based on a measured value on the non-image region located by the non-image region locating portion.

4. The document reading apparatus according to claim 3, wherein the control portion irradiates light from the light-emitting portion to a transported document and measures reflected light received by the light-receiving portion from a plurality of measurement positions on the document, and after these measurements, determines whether or not the plurality of measurement positions are respectively in a non-image region located by the non-image region locating portion, and adjusts a light amount of the light-emitting portion by controlling the irradiated light adjustment portion based on the measured value on the measurement position corresponding to the image position located within the non-image region which image position are determined among the plurality of measurement positions.

5. The document reading apparatus according to claim 3, further comprising a guiding member, which is provided in the sheet transport path and guides a document transported toward the reflective type optical sensor such that the document is flat.

6. An image forming apparatus comprising:

a sheet transport apparatus that transports a recording paper and an input portion into which image data corresponding to an image to be formed on a recording paper is inputted, wherein the sheet transport apparatus comprises:

a sheet transport path for transporting the recording paper in a predetermined transport direction, a reflective type optical sensor, which has a light-emitting portion and a light-receiving portion, and in which light irradiated from the light-emitting portion to the recording paper transported on the sheet transport path is reflected and reflected light from the recording paper is received by the light-receiving portion to detect a presence/absence of the recording paper, an irradiated light adjustment portion that adjusts a light amount of the light-emitting portion, a non-image region locating portion that detects an image state on the recording paper based on image data stored in an image memory to locate a non-image region of the recording paper, and a control portion that adjusts the light amount of the light-emitting portion by controlling the irradiated light adjustment portion based on a measured value on the non-image region located by the non-image region locating portion.

7. The image forming apparatus according to claim 6, wherein the control portion irradiates light from the light-emitting portion to a transported recording paper and measures reflected light received by the light-receiving portion from a plurality of measurement positions on the recording paper, and after these measurements, determines whether or not the plurality of measurement positions are respectively in a non-image region located by the non-image region locating portion, and adjusts a light amount of the light-emitting portion by controlling the irradiated light adjustment portion based on the measured value on the measurement position corresponding to the image position located within the non-image region which image position are determined among the plurality of measurement positions.

8. The image forming apparatus according to claim 6, further comprising a guiding member, which is provided in the sheet transport path and guides a recording paper transported toward the reflective type optical sensor such that the recording paper is flat.

* * * * *